US012070114B2

(12) United States Patent
Lelieveld

(10) Patent No.: US 12,070,114 B2
(45) Date of Patent: Aug. 27, 2024

(54) HAIR DRYER WITH SENSOR AND REMOVABLE ATTACHMENT

(71) Applicant: KONINKLIJKE PHILIPS N.V., Eindhoven (NL)

(72) Inventor: Mark Johannes Lelieveld, Shatin (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 715 days.

(21) Appl. No.: 17/259,575

(22) PCT Filed: Jul. 16, 2019

(86) PCT No.: PCT/EP2019/069062
§ 371 (c)(1),
(2) Date: Jan. 12, 2021

(87) PCT Pub. No.: WO2020/020693
PCT Pub. Date: Jan. 30, 2020

(65) Prior Publication Data

US 2021/0330052 A1 Oct. 28, 2021

(30) Foreign Application Priority Data

Jul. 25, 2018 (EP) ..... 18185423

(51) Int. Cl.
*A45D 20/12* (2006.01)
*A45D 44/00* (2006.01)

(52) U.S. Cl.
CPC ..... *A45D 20/122* (2013.01); *A45D 44/00* (2013.01); *A45D 2044/007* (2013.01)

(58) Field of Classification Search
CPC . A45D 20/122; A45D 44/00; A45D 2044/007
USPC ..... 34/95–100
See application file for complete search history.

(56) References Cited

U.S. PATENT DOCUMENTS

| | | | | |
|---|---|---|---|---|
| 3,943,329 | A | 3/1976 | Hlavac | |
| 4,424,437 | A | 1/1984 | Walter | |
| 5,956,863 | A | 9/1999 | Allen | |
| 6,026,821 | A * | 2/2000 | Last | A45D 20/12 132/211 |
| 9,936,789 | B2 * | 4/2018 | Stephens | A45D 20/122 |

(Continued)

FOREIGN PATENT DOCUMENTS

| | | |
|---|---|---|
| CN | 2882184 | 3/2007 |
| CN | 203789379 U | 8/2014 |

(Continued)

OTHER PUBLICATIONS

International Search Report and Written Opinion Dated Sep. 18, 2020 For International Application No. PCT/EP2019/069062 Filed Jul. 16, 2019.

*Primary Examiner* — Stephen M Gravini

(57) ABSTRACT

A hair dryer (H) comprises a sensor (S) mounted on the hair dryer (H) to sense a hair property, and a removable attachment (A) provided with a first channel (C1) for passing air from the hair dryer (H) to hair, and a second channel (C2) for allowing the sensor (S) to sense the hair property through the second channel (C2), the second channel (C2) being distinct from the first channel (C1). The second channel (C2) may be an inner tube of the removable attachment (A). The second channel (C2) may have a conical shape.

7 Claims, 1 Drawing Sheet

(56) References Cited

U.S. PATENT DOCUMENTS

| | | | | |
|---|---|---|---|---|
| 10,213,001 | B2 * | 2/2019 | Stephens | A45D 20/122 |
| 11,607,023 | B2 * | 3/2023 | Chang | A45D 20/12 |
| 2004/0163274 | A1 | 8/2004 | Andrew | |
| 2010/0212179 | A1 | 8/2010 | Schmid | |
| 2012/0055501 | A1 | 3/2012 | Seng | |
| 2014/0290087 | A1 * | 10/2014 | Weatherly | A45D 20/12 34/98 |
| 2018/0036553 | A1 | 2/2018 | Shiibashi | |
| 2020/0221846 | A1 * | 7/2020 | Savane | A45D 20/122 |
| 2021/0330052 | A1 * | 10/2021 | Lelieveld | A45D 20/10 |
| 2023/0255335 | A1 * | 8/2023 | Lelieveld | A45D 20/10 34/96 |

FOREIGN PATENT DOCUMENTS

| | | | | |
|---|---|---|---|---|
| CN | 206586556 | | 10/2017 | |
| EP | 2648565 | B1 * | 2/2019 | A45D 20/00 |
| EP | 3598919 | A1 * | 1/2020 | A45D 20/10 |
| GB | 2508589 | | 6/2014 | |
| JP | 5095813 | A | 4/1993 | |
| JP | H05199915 | | 8/1993 | |
| JP | 03184955 | U | 7/2013 | |
| JP | 3184955 | U | 7/2013 | |
| KR | 20100089717 | | 8/2010 | |
| WO | WO-2012076885 | A2 * | 6/2012 | A45D 20/00 |
| WO | 2013076407 | | 5/2013 | |

* cited by examiner

HAIR DRYER WITH SENSOR AND REMOVABLE ATTACHMENT

CROSS REFERENCE TO RELATED APPLICATIONS

This application is the U.S. National Phase application under 35 U.S.C. § 371 of International Application No. PCT/EP2019/069062 filed Jul. 16, 2019, which claims the benefit of European Patent Application Number 18185423.3 filed Jul. 25, 2018. These applications are hereby incorporated by reference herein.

FIELD OF THE INVENTION

The invention relates to a hair dryer provided with a sensor and a removable hair dryer attachment.

BACKGROUND OF THE INVENTION

U.S. Pat. No. 4,424,437 discloses an electric hair dryer having a radiometer which remotely senses the infrared radiation emanating from the hair being dried and which contains a control means that causes the heating means in the dryer to turn off when the infrared radiation indicates the temperature of the hair is about 50° C. In an embodiment, a radiometric detector system housing is attached, either by being molded as a part thereof or by suitable screws, on the external surface of the dryer housing near the air outlet end.

CN206586556U discloses a hair dryer which automatically adjusts temperature according to distance. The front end of the outer casing is provided with an air outlet and an air hood. The temperature regulating system comprises an infrared probe on the upper end of the outer casing to detect the distance between the person and the hair dryer.

JPH05199915A discloses a hair dryer having an arrangement to prevent a nozzle attached to a blowout port from disturbing the non-contact measurement of a hair temperature by providing a control means for controlling a rotational range of the nozzle.

SUMMARY OF THE INVENTION

It is, inter alia, an object of the invention to provide an improved hair dryer attachment. The invention is defined by the independent claim. Advantageous embodiments are defined in the dependent claims.

Aspects of the invention provide a hair dryer comprising a sensor mounted on the hair dryer to sense a hair property, and a removable attachment provided with a first channel for passing air from the hair dryer to hair, and a second channel for allowing the sensor to sense the hair property through the second channel, the second channel being distinct from the first channel. The second channel may be an inner tube of the removable attachment. The second channel may have a conical shape.

The invention is based on the following recognitions. Hair dryers are used for hair drying and styling. For styling, attachments are used. Typical styling attachments are nozzles, massagers, and diffusors. Diffusors are used to create volume or dry curly hairs. The width of such diffusors is usually in the range of 80 to 160 mm. In previous propositions of sensing temperature, the sensor was mounted in the middle of the air outlet of the hair dryer body, and therefore the air inlet of the attachment could cater for a hole to allow a sensing of the hair temperature even when an attachment is present between the body of the hair dryer and the hair. However, if, as in U.S. Pat. No. 4,424,437, the sensor is mounted on the tip of the hair dryer, the sensing path is blocked by the attachment. The invention aims to overcome this problem, preferably without compromising on sensing performance.

Embodiments of the invention allow non-contact sensors (e.g. camera, IR sensor or other kind of temperature sensor, etc.) a pathway through attachments to sense the hair without frustrating the air path (styling performance). The pathway may be an inner tube in the attachment allowing the air stream to "go around" inside the attachment air chamber to enable even airflow out of the diffusor and a clear sensing path through the attachment. This allows both an even air distribution for drying/styling, and the sensor to sense the hair property (e.g. temperature) in the working area instead of besides the working area.

These and other aspects of the invention will be apparent from and elucidated with reference to the embodiments described hereinafter.

DESCRIPTION OF EMBODIMENTS

Figure 1:
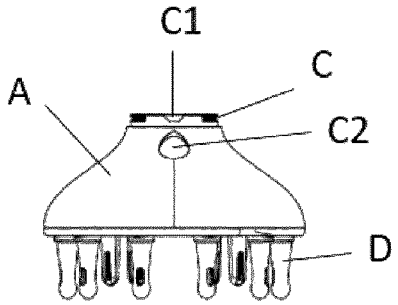
FIG. 1 shows a side view of an attachment in accordance with an embodiment of the invention.
Figure 2:
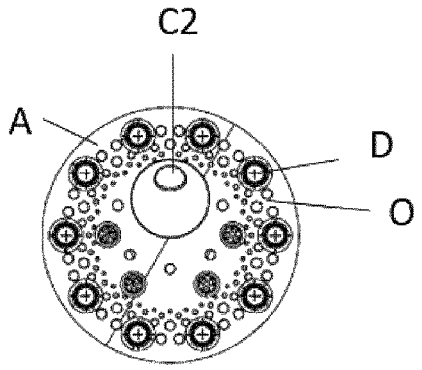
FIG. 2 shows a front view of an attachment in accordance with an embodiment of the invention.
Figure 3:
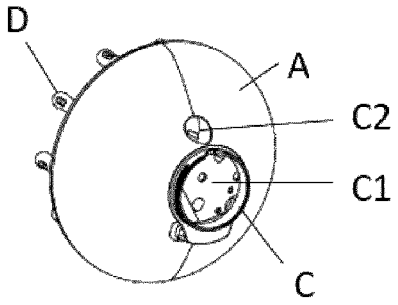
FIG. 3 shows a rear view of an attachment in accordance with an embodiment of the invention.
Figure 4:
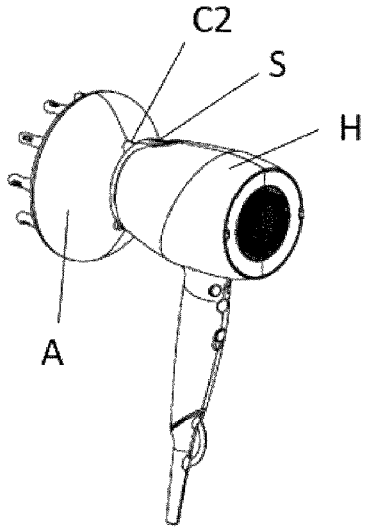
FIG. 4 shows a rear view of a hair dryer provided with an attachment in accordance with an embodiment of the invention.

In the example shown in FIGS. 1-4, the attachment A is a diffuser that can be removably mounted on a hair dryer H. The attachment A has a connector C that allows the attachment A to be connected to the hair dryer H, and various diffuser pins D. As usual, the attachment A has a first channel C1 between the hair dryer H, and a plurality of air outlet openings O on a front side of the attachment A; the diffuser pins D too have air outlet openings.

In accordance with the present invention, the attachment A further has a second channel C2 that allows a sensor S mounted on the hair dryer H to "see" the hair so that the sensor S can measure a hair property without being prevented from doing so by the attachment between the hair dryer and the hair. In various embodiments, the second channel C2 is a kind of inner tube between the rear side of the attachment A, where the second channel C2 faces the sensor S on the hair dryer H, and the front side of the attachment A. Advantageously, it has a kind of conical shape so that an opening of the second channel C2 on the front side of the attachment A is wider than an opening of the second channel C2 of the rear side of the attachment A, thereby following the "field of view" of the sensor S on the hair dryer H.

It should be noted that the above-mentioned embodiments illustrate rather than limit the invention, and that those skilled in the art will be able to design many alternative embodiments without departing from the scope of the appended claims. In the claims, the notion "hair dryer" also covers products that are marketed as "air styler", "hair stylers", etc., and the air supplied by the hair dryer does not necessarily have to be hot. As shown in the embodiments, the first channel C1 may be any path for the air that may have any shape. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. So, there may e.g. be multiple first channels C1. The invention may be implemented by means of hardware comprising several distinct elements. In the device claim enumerating several means, several of these means may be embodied by one and the same item of hardware. Measures recited in mutually different dependent claims may advantageously be used in combination.

The invention claimed is:

1. A hair dryer, comprising:

a sensor mounted on the hair dryer to sense a hair property; and a removable attachment provided with a first channel for passing air from the hair dryer to hair, and a second channel for allowing the sensor to sense the hair property through the second channel and comprising a first opening on a front side of the removable attachment and a second opening on a rear side of the removable attachment opposite the front side of the removable attachment, the second channel being distinct from the first channel and aligning with the sensor mounted on the hair dryer when the removable attachment is attached to the hair dryer.

2. The hair dryer as claimed in claim 1, wherein the second channel is an inner tube of the removable attachment.

3. The hair dryer as claimed in claim 1, wherein the second channel has a conical shape such that the first opening is wider than the second opening.

4. The hair dryer as claimed in claim 2, wherein the second channel has a conical shape such that the first opening is wider than the second opening.

5. The hair dryer as claimed in claim 1, wherein the removable attachment comprises a diffuser with a connector that enables attachment to the hair dryer and a plurality of diffuser pins with air outlet openings.

6. The hair dryer as claimed in claim 2, wherein the removable attachment comprises a diffuser with a connector that enables attachment to the hair dryer and a plurality of diffuser pins with air outlet openings.

7. The hair dryer as claimed in claim 1, wherein the second channel faces the sensor.

* * * * *